US008066017B1

(12) United States Patent
Born et al.

(10) Patent No.: US 8,066,017 B1
(45) Date of Patent: Nov. 29, 2011

(54) HAIR DRYER ATTACHMENT

(75) Inventors: Adriana Born, Seabrook, TX (US); Carrie Colley, Seabrook, TX (US)

(73) Assignee: Adriana Born, Seabrook, TX (US)

( * ) Notice: Subject to any disclaimer, the term of this patent is extended or adjusted under 35 U.S.C. 154(b) by 245 days.

(21) Appl. No.: 12/473,979

(22) Filed: May 28, 2009

Related U.S. Application Data

(60) Provisional application No. 61/058,194, filed on Jun. 2, 2008.

(51) Int. Cl.
*A45D 20/08* (2006.01)

(52) U.S. Cl. ..... 132/271

(58) Field of Classification Search ..... 132/271, 132/272, 212; 34/96–102; 239/443, 468, 239/499, 562; 261/127, 131, 137, 138
See application file for complete search history.

(56) References Cited

U.S. PATENT DOCUMENTS

| | | | | | |
|---|---|---|---|---|---|
| 1,951,269 | A * | 3/1934 | Boeckx et al. | 132/212 |
| 3,073,037 | A * | 1/1963 | Fay | 34/99 |
| 3,198,196 | A * | 8/1965 | Sawin | 132/212 |
| 4,019,260 | A * | 4/1977 | Levy et al. | 34/97 |
| D260,189 | S | 8/1981 | Winkler | |
| 4,287,673 | A | 9/1981 | Wolter | |
| D265,598 | S | 7/1982 | Ridatz | |
| 4,391,047 | A * | 7/1983 | Janssens et al. | 34/97 |
| 4,528,919 | A | 7/1985 | Harbolt et al. | |
| 4,629,863 | A | 12/1986 | Giordano | |
| 4,955,145 | A * | 9/1990 | Scivoletto | 132/271 |
| D380,540 | S | 7/1997 | Seatvet et al. | |
| 5,725,159 | A | 3/1998 | Dorber et al. | |
| 5,868,148 | A * | 2/1999 | Lindsey et al. | 132/271 |
| 6,957,500 | B2 * | 10/2005 | McCambridge et al. | 34/96 |
| 7,040,037 | B2 | 5/2006 | Keong | |
| 2008/0271337 | A1 * | 11/2008 | Chan | 34/98 |
| 2009/0083986 | A1 * | 4/2009 | Langley et al. | 34/98 |

* cited by examiner

*Primary Examiner* — Todd Manahan
*Assistant Examiner* — Tatiana Nobrega
(74) *Attorney, Agent, or Firm* — Egbert Law Offices PLLC

(57) ABSTRACT

An attachment for a hair dryer has a hollow body portion with an upper end in fluid communication with a lower end, a lip connected to and extending upwardly from the upper end of the hollow body portion, and a nozzle extending through an opening in the lip. The nozzle has a connector for connecting the attachment to a hair dryer and a tip interior of the lip pointing generally downwardly toward the hollow body portion. The nozzle is rotatable such that the tip of the nozzle can be directionally adjusted. A baffle is affixed to an opening at the lower end of the hollow body portion.

17 Claims, 2 Drawing Sheets

HAIR DRYER ATTACHMENT

RELATED U.S. APPLICATIONS

The present application claims priority from U.S. Provisional Patent Application Ser. No. 61/058,194, filed on Jun. 2, 2008, and entitled "HAIR DRYER ATTACHMENT."

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the styling of hair. More particularly, the present invention relates the styling of hair using a hair dryer. More particularly, the present invention the relates to attachments for hair dryers.

2. Description of Related Art Including Information Disclosed Under 37 CFR 1.97 and 37 CFR 1.98.

Hair dryers are typically used to accelerate the drying time of wet hair. Hair dryers typically have a handle and a tubular blower portion. The handle is used by the user to position the hair dryer near hair that is wet. A mechanical device in the hair dryer accelerates a flow of air through the tubular blower portion. The accelerated air exits an end of the tubular blower portion so as to blow high velocity air past wet hair. The high velocity of the air acts to accelerate the evaporation of water particles from wet hair. Hair dryers typically come with variable speeds. Thus, the user of a hair dryer can control the acceleration of air within the hair dryer, and thus the velocity of air exiting the end of the tubular blower portion of the hair dryer. Hair dryers are typically equipped with heating coils that heat the air passing through the hair dryer. The heated air also acts to accelerate the evaporation of water particles from wet hair. Hair dryers usually have the ability to turn the heating coils on or off as desired by the user.

Over time, people discovered that hair dryers can also be used to style hair. The various methods and techniques for using a hair dryer to style hair can be seen in any local or commercial barber shop. Many hairstylists have had successful and prosperous careers due to their ability to eloquently style the hair of customers. Hair styles have quickly become a way for people to express themselves and even to communicate various values. In fact, the styling of hair has even become a fashion phenomenon causing hair styles to change over time due to trends and popular social values. Thus, there is always a need for new ways to style hair. Various patents have issued relating to devices that control the flow of air while styling a person's hair. For example, U.S. Pat. No. 4,629,863, issued on Dec. 16, 1986 to Giordano, discloses a hair dryer outlet nozzle having a slit-like outlet opening that includes a forwardly and upwardly extending arcuate deflector of approximately half-circle form, which directs drying air away from the scalp and forms a vortex of drying air around a cylindrical brush upon which hair is wound during the drying process.

U.S. Pat. No. 5,725,159, issued on Mar. 10, 1998 to Dorber et al., discloses an air directing device for a hair dryer for acting upon the air stream exiting from the hair dryer in which an air directing member is configured as a substantially tubular body having an inlet opening and an outlet area. The air outlet area has individual orifices configured and positioned such that the exiting air stream is split into substantially independent free jets.

U.S. Pat. No. 7,040,037, issued on May 9, 2006 to Keong, discloses a diffuser for a handheld electric hair dryer that includes a base from which fingers extend. Each finger has a longitudinal through-passage through which hot air passes from the base. A thermal-capacitance element is attached to the base so as to moderate changes in temperature of air exhausted through the diffuser.

U.S. Pat. No. 4,287,673, issued on Sep. 8, 1981 to Wolter, discloses a diffuser attachment which is telescopically assembled to the air outlet end of a hand-held hair dryer and which is characterized by a forwardly flared body portion and by a diffuser plate concentrically mounted within the flared body portion and having a convex surface facing the flow of heated air from the hair dryer.

U.S. Pat. No. 4,528,919, issued on Jul. 16, 1985 to Harbolt et al., discloses an apparatus and method for dividing a flowing multi-phase fluid to provide at least two separate fluid streams wherein each fluid stream has substantially the same ratio of phases. The apparatus includes a fluid inlet chamber in fluid communication with at least two separate fluid outlet chambers. Fluid conduits connect the inlet chamber with the outlet chambers. Each of the conduits has a fluid conduit inlet opening communicating with the fluid inlet chamber and a fluid outlet opening communicating with one of the fluid outlet chambers. The fluid conduit inlet openings are arrayed in groups, wherein each group has at least two members, and the fluid conduits are adapted to provide that each fluid outlet chamber is in fluid communication with only one member of each group of fluid conduit inlet openings.

U.S. Design Pat. No. D260,189, issued on Aug. 11, 1981 to Winkler, discloses a hair dryer attachment that is attached to an end of a hair dryer. The attachment has a tubular portion and a concave portion mounted to an end of the tubular portion. The concave portion has a hole in a wall thereof so that air from the tubular portion can pass through the concave portion. The concave portion has a cross section of a semicircle.

U.S. Design Pat. No. D380,540, issued Jul. 1, 1997 to Seatvet et al., discloses a portable heater-blower that attaches to an end of a hair dryer. The heater-blower has a first portion that is tubular and is mounted around the end of a hair dryer. A U-shaped portion is integrally formed at an end of the first portion so that air from the first portion passes into a first branch of the U-shaped portion and a second branch of the U-shaped portion.

U.S. Design Pat. No. D265,598, issued on Jul. 27, 1982 to Ridatz, discloses a diffuser for a hair dryer. The diffuser is an ornamental design for a diffuser for a hair dryer that is disclosed in U.S. Pat. No. 4,287,673.

It is an object of the present invention to provide an apparatus that styles hair.

It is another object of the present invention to provide an apparatus that styles hair using a hair dryer.

It is another object of the present invention to provide an apparatus that quickly styles hair.

It is another object of the present invention to provide an apparatus that styles hair by spinning the hair within a hair dryer attachment.

It is another object of the present invention to provide an apparatus that can dry hair while styling the hair.

It is still another object of the present invention to provide an apparatus that has many configurations for styling hair.

It is another object of the present invention to provide an apparatus that can be configured so as to provide a certain hair style.

These and other objects and advantages of the present invention will become apparent from a reading of the attached specification and appended claims.

BRIEF SUMMARY OF THE INVENTION

The present invention is an attachment for a hair dryer having a hollow body portion with openings at each end, a lip connected to and extending upwardly from the upper end of the hollow body portion, and a nozzle extending through an opening in the lip. The hollow body portion has an upper end in fluid communication with a lower end. The hollow body portion may be frusto-conical or spherical in shape. The nozzle has a first portion extending exterior of the lip and a second portion extending interior of the lip. The first portion has a connecting means for connecting the nozzle to a hair dryer. The connecting means may be formed of an elastomeric material. The second portion has an elbow thereon such that the tip of the second portion of the nozzle points generally downwardly interior of the lip toward the hollow body portion. The nozzle is rotatable such that the tip can be directionally adjusted.

There is a baffle affixed to the opening at the lower end of the hollow body portion. The baffle may be an annular ring which has an opening through the center thereof. The baffle may also be a circular disk having a plurality of holes formed therethrough. The present invention may have a second hollow body portion affixed to the lower end of the hollow body portion and in fluid communication with the hollow body portion. The upper end of the second hollow body portion is narrower than the lower end.

The present invention is also an attachment for a hair dryer having a hollow body portion with a frusto-conical shape and a nozzle extending through a wall of the hollow body portion. The hollow body portion has a wider upper end in fluid communication with a narrower lower end. The tip is suitably shaped to point downwardly toward the lower end of the hollow body portion. A baffle is affixed to the opening at the lower end of the hollow body portion.

The present invention is also an attachment for a hair dryer having a first tubular body portion with an upper end and a lower end, a lip affixed to and extending upwardly from the first tubular portion, a rotatable nozzle extending through the wall of the lip, and a second tubular body portion affixed to and in fluid communication with the first tubular body portion.

DETAILED DESCRIPTION OF THE INVENTION

Figure 1:
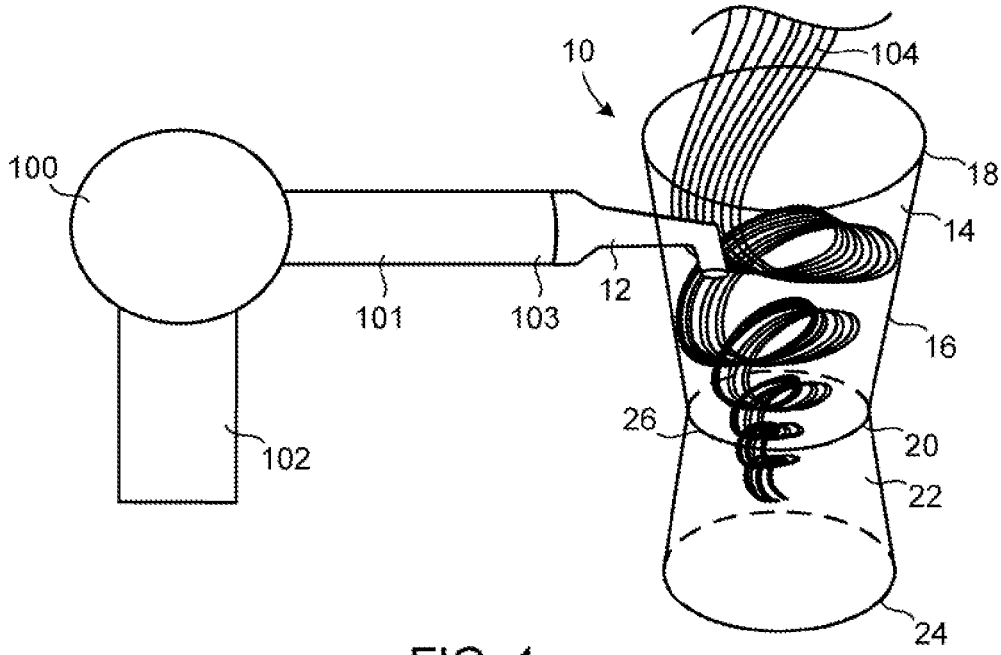
FIG. 1 shows a side perspective view of the hair dryer attachment of the present invention.

Referring to FIG. 1, there is shown a side perspective view of the hair dryer attachment 10 of the present invention. The hair dryer attachment 10 has a first portion 14 and a second portion 22. The first portion 14 has a wall 16. A nozzle 12 extends through the wall 16 of the first portion 14. The nozzle 12 is positioned near a wide end 18 of the first portion 14, and the nozzle 12 points generally toward the narrow end 20 of the first portion 14. The narrow end 20 of the first portion 14 is in fluid communication with the narrow end 26 of the second portion 22. Thus, the attachment 10 tapers from the wide end 18 of the first portion 14 to the narrow ends 20 and 26 of the first and second portions 14 and 22, respectively. The attachment 10 then expands from the narrow ends 20 and 26 of the first portion 14 and the second portion 22, respectively, to the wide end 24 of the second portion 22.

The hair dryer 100 has a handle 102 and a tubular blower portion 101. Air is accelerated in the hair dryer 100 and exits the end 103 of the tubular blower portion 101 into the nozzle 12. Air flows out of the nozzle 12 in a direction generally towards the narrow end 20 of the first portion 14. The air then flows from the narrow end 26 of the second portion 22 out of the wide end 24 of the second portion 22. While in the attachment 10, the accelerated air swirls inside the first portion 14 and second portion 22. The swirling path of air that is accelerated by the hair dryer 100 is determined by the direction of the nozzle 12 and by the configuration of the first portion 14 and the second portion 22 of the hair dryer attachment 10. The desired effect of the various shapes of the components of the hair dryer attachment 10 is to create a swirling or venturi effect. The first portion 14 of the attachment 10 is frusto-conical in shape. The second portion 22 of the attachment 10 is also frusto-conical in shape. The first portion 14 is longer than the second portion 22. As used herein, frusto-conical can include a bowl shape and an irregular frusto-conical shape wherein the upper end is wider than the lower end.

The nozzle 12 is attached to the end 103 of the blower portion 101 of the hair dryer 12. The nozzle 12 may be made of an elastomeric material adjacent the end 103 of the hair dryer 12 so as to allow for attachment of the nozzle 12 to hair dryers having blower portions 101 of varying sizes. The use of the elastomeric material allows for the attachment 10 to have a universal-fit feature. Alternatively, the nozzle 12 may have a configuration suitable for screwing onto an end 103 of a hair dryer. A specially-made hair dryer may also have a suitable shape for connection to the nozzle 12.

Hair 104 is placed into the attachment 10 and can extend into the first portion 14 and the second portion 22. The hair dryer 100 is then powered so as to accelerate air through the tubular blower portion 101. The accelerated air exits the tubular blower portion 101 through end 103 and into the nozzle 12. The nozzle 12 then causes the accelerated air to swirl within the first portion 14 and second portion 22. The swirling air in the first portion 14 and the second portion 22 causes the hair 104 extending therethrough to swirl with the flow of air. As such, the present invention creates a very unique appearance of the hair 104. The hair 104 is swirled as it is dried so as to create this unique appearance.

Figure 2:
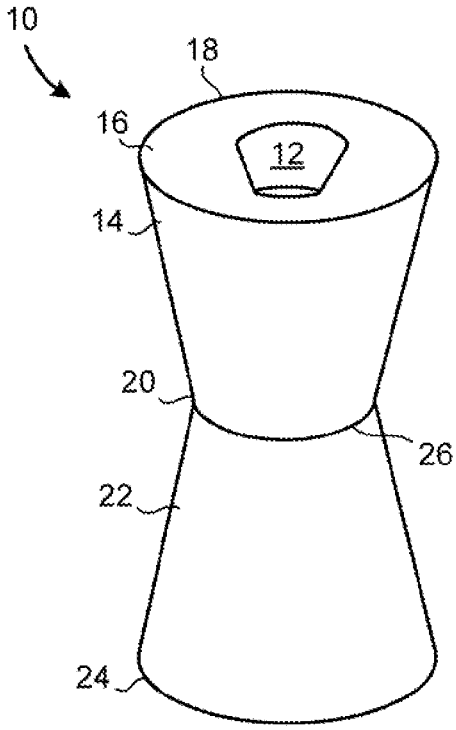
FIG. 2 shows a front elevational view of the hair dryer attachment of the present invention.

Referring to FIG. 2, there is shown a side elevational view of the hair dryer attachment 10 of the present invention. The nozzle 12 is shown as extending through the wall 16 of the first portion 14 and pointing downwardly towards the narrow end 20 of the first portion 14. The first portion 14 and the second portion 22 are comparable in size. Both the first portion 14 and the second portion 22 are frusto-conical in shape. The narrow end 20 of the first portion 14 is in fluid communication with the narrow end 26 of the second portion 22. The nozzle 12 is shown in FIG. 2 as oriented directly downwardly toward the narrow end 20 of the first portion 14.

The present invention contemplates that the nozzle 12 can be rotatable so as to be oriented in any direction that is suitable for creating a swirling motion of air within the first portion 14 and the second portion 22. In some cases, a user may desire the hair to be curled in opposite directions on opposite sides of the head. The rotatable feature allows the user to control the direction of the curling of the hair.

Figure 3:
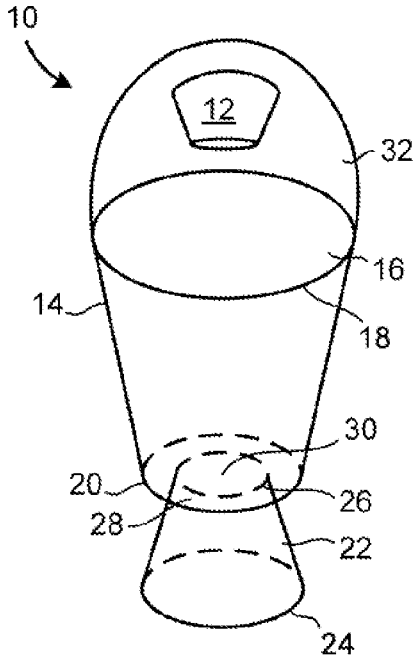
FIG. 3 shows a front perspective view of the preferred embodiment of the hair dryer attachment of the present invention.

Referring to FIG. 3, there is shown a side perspective view of the preferred embodiment of the hair dryer attachment 10 of the present invention. The nozzle 12 is shown as extending through a lip 32 that is mounted to the wide end 18 of the first portion 14. The nozzle 12 points generally downwardly toward the narrow end 20 of the first portion 14. The nozzle 12 may have an elbow or other suitable curvature so as to point generally downwardly. The first portion 14 and the second portion 22 are both frusto-conical in shape, yet the second portion 22 is substantially smaller than the first portion 14. The narrow end 20 of the first portion 14 is in fluid communication with the narrow end 26 of the second portion 22. A baffle 28 extends between the narrow end 26 of the second portion 22 and the narrow end 20 of the first portion 14. The fluid connection between the first portion 14 and second portion 22 is a baffle 28 having one large hole 30 for the passage of air therethrough. In FIG. 3, air passes out of the nozzle 12, along the surface of the lip 32, and into the first portion 14. The air then swirls in the first portion 14 from the wide end 18 to the narrow end 20, passes through the baffle 28 and swirls from the narrow end 26 to the wide end 24 of the second portion 22. The present invention contemplates that the hair dryer attachment 10 shown in FIG. 3 can have the nozzle 12 mounted on the wall 16 of the first portion 14 instead of being mounted on the lip 32.

Figure 4:
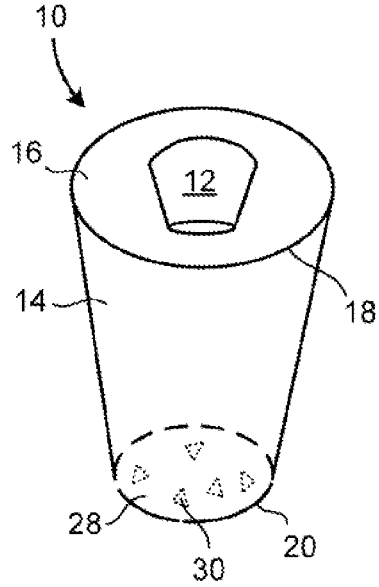
FIG. 4 shows a front perspective view of an alternative embodiment of the hair dryer attachment of the present invention.

Referring to FIG. 4, there is shown a side perspective view of an alternative embodiment of the hair dryer attachment 10 of the present invention. This embodiment shows only a first portion 14. In certain cases, a second portion may be unnecessary. The first portion 14 has a baffle 28 at the narrow end 20 thereof. The baffle 28 has holes 30 formed therein. The holes 30 can be of any number and of any geometric shape suitable for creating a swirling motion of air within the first portion 14. The embodiment of the baffle 28 shown in FIG. 4 could be used as the baffle 28 in FIG. 3. A lip could also be added to the wide end 18 of the first portion 14 of this embodiment.

Figure 5:
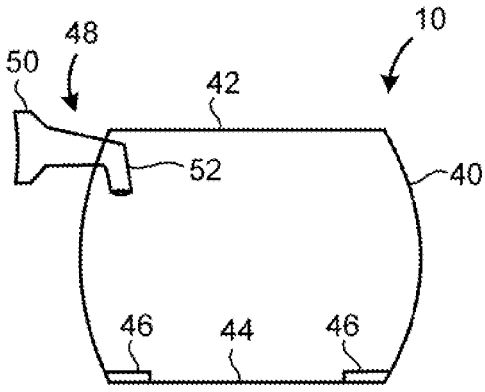
FIG. 5 shows a side perspective view of another alternative embodiment of the hair dryer attachment of the present invention.

Referring to FIG. 5, there is shown another alternative embodiment of the hair dryer attachment 10 of the present invention. This embodiment shows a bowl-shaped configuration of the first portion 40. As with the other embodiments, this embodiment has open ends 42 and 44. The nozzle 48 has an interior portion 52 and an exterior portion 50. The interior portion 52 directs airflow and the exterior portion 50 is attached to a hair dryer. The baffle 46 is show adjacent the open end 44.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An apparatus comprising:

a hair dryer producing a flow of air in a direction; and an attachment comprising:

a hollow body portion having openings at each end, said hollow body portion having an upper end and a lower end, said upper end in fluid communication with said lower end;

a lip connected to and extending upwardly from said upper end of said hollow body portion; and a nozzle extending through an opening in said lip, said nozzle attachable to the hair dryer, said nozzle having a first portion aligned with the direction of the flow of air from the hair dryer and a second portion directing the flow of air from said first portion toward said lower end of said hollow body portion in a direction generally transverse to the direction of the flow of air from the hair dryer.

2. The attachment of claim 1, said first portion of said nozzle extending exterior of said lip, said second portion extending interior of said lip.

3. The attachment of claim 1, said first portion of said nozzle having a connecting means formed integrally thereof, said connecting means for connecting said nozzle to through hair dryer.

4. The attachment of claim 3, said connecting means being formed of an elastomeric material.

5. The attachment of claim 1, said second portion of said nozzle having an elbow formed thereon such that a tip of said second portion of said nozzle points generally downwardly interior of said lip toward said hollow body portion.

6. The attachment of claim 1, further comprising:

a baffle affixed to an opening at said lower end of said hollow body portion.

7. The attachment of claim 6, said baffle being an annular ring having an opening through a center thereof.

8. The attachment of claim 6, said baffle being a circular disk having a plurality of holes formed therethrough.

9. The attachment of claim 1, said hollow body portion having a frusto-conical shape.

10. The attachment of claim 1, further comprising:

a second hollow body portion affixed to said lower end of said hollow body portion, said second body portion having an interior passageway, said second body portion being in fluid communication with said hollow body portion.

11. The attachment of claim 1, said hollow body portion having a generally spherical shape.

12. An apparatus comprising:

a hair dryer producing a flow of air in a direction; and an attachment comprising:

a hollow body portion having frustoconical shape, said hollow body portion having an upper end having a width greater than a width of a lower end thereof, said upper end in fluid communication with said lower end, said width of said upper end being suitable for allowing hair to be placed therein;

a nozzle extending through a wall of said hollow body portion, said nozzle comprising:

a connecting means positioned exterior of said wall, said connecting means for connecting said nozzle to an outlet of the hair dryer;

a first portion extending from said connecting means, said first portion being of a tubular shape suitable for passing the flow of air therethrough in a direction aligned with the direction of air from the hair dryer;

a second portion in fluid communication with said first portion and extending transverse to said first portion so as to direct the flow of air therethrough from said first portion toward said lower end of said hollow body portion; and a tip at one end of said second portion opposite said first portion, said tip being suitably shaped to point downwardly toward said lower end of said hollow body portion.

13. The attachment of claim 12, said connecting means being formed of an elastomeric material.

14. The attachment of claim 12, further comprising:

a second hollow body portion affixed to said lower end of said hollow body portion, said second hollow body portion having openings at each end, said second hollow body portion being in fluid communication with said hollow body portion.

15. The attachment of claim 12, said hollow body portion having a lip extending generally upwardly therefrom, said nozzle extending through said lip of said hollow body portion.

16. The attachment of claim 12, further comprising:

a baffle affixed to an opening at said lower end of said hollow body portion.

17. An apparatus comprising:

a hair dryer having an outlet through which air passes in a direction;

a nozzle removably affixed to said outlet of said hair dryer, said nozzle having a first portion and a second portion, said first portion connected to said outlet of said hair dryer so as to pass air therethrough in a direction axially aligned with said outlet of said hair dryer, said second portion extending from an end of said first portion opposite to said outlet of said hair dryer, said second portion extending in a direction generally transverse to said first portion so as to direct the air in a path transverse to a path of the air through said first portion; and a frustoconical body having a wall and an interior, said nozzle having said first portion extending through said wall of said frustoconical body, said second portion directed toward a bottom of said frustoconical body, said bottom of said frustoconical body having a baffle adjacent to said bottom so as to construct the flow of air therethrough.

* * * * *